US009547247B2

(12) United States Patent
Ozawa et al.

(10) Patent No.: US 9,547,247 B2
(45) Date of Patent: Jan. 17, 2017

(54) TONER AND METHOD OF MANUFACTURING THE SAME

(71) Applicant: KYOCERA Document Solutions Inc., Osaka (JP)

(72) Inventors: Yoshio Ozawa, Osaka (JP); Noriaki Sakamoto, Osaka (JP); Ken Maetani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 15 days.

(21) Appl. No.: 14/597,405

(22) Filed: Jan. 15, 2015

(65) Prior Publication Data

US 2015/0205220 A1 Jul. 23, 2015

(30) Foreign Application Priority Data

Jan. 23, 2014 (JP) ..... 2014-010216

(51) Int. Cl.
*G03G 9/093* (2006.01)

(52) U.S. Cl.
CPC ..... *G03G 9/09314* (2013.01); *G03G 9/09321* (2013.01); *G03G 9/09328* (2013.01); *G03G 9/09364* (2013.01); *G03G 9/09371* (2013.01); *G03G 9/09392* (2013.01)

(58) Field of Classification Search
CPC ..... G03G 9/03; G03G 9/093; G03G 9/09307
See application file for complete search history.

(56) References Cited

FOREIGN PATENT DOCUMENTS

| | | | |
|---|---|---|---|
| JP | S55-166655 | A | 12/1980 |
| JP | S59-214860 | A | 12/1984 |
| JP | S60-107037 | A | 6/1985 |
| JP | H02-880 | A | 1/1990 |
| JP | 2009-237110 | A | 10/2009 |
| JP | 2013-114092 | A | 6/2013 |
| JP | 2013-228556 | A | 11/2013 |

OTHER PUBLICATIONS

An Office Action; "Notification of Reasons for Refusal" issued by the Japanese Patent Office on Jul. 19, 2016, which corresponds to Japanese Patent Application No. 2014-010216 and is related to U.S. Appl. No. 14/597,405.

*Primary Examiner* — Peter Vajda
(74) *Attorney, Agent, or Firm* — Studebaker & Brackett PC

(57) ABSTRACT

A toner includes a plurality of toner particles that each include a core and a shell layer disposed over a surface of the core. The shell layer contains a unit derived from a thermoplastic resin and a unit derived from a monomer or prepolymer of a thermosetting resin. A surface of each of the toner particles has a Young's modulus that changes by a proportion of no greater than 20% from 30° C. to 50° C., and changes by a proportion from 50° C. to 70° C. that when divided by the proportion of change from 30° C. to 50° C., yields a value of at least 3.0 and no greater than 10.0. The Young's modulus is measured in a state in which an external additive is not adhered to the toner particle using a scanning probe microscope while raising a cantilever temperature thereof.

20 Claims, 2 Drawing Sheets

TONER AND METHOD OF MANUFACTURING THE SAME

INCORPORATION BY REFERENCE

The present application claims priority under 35 U.S.C. §119 to Japanese Patent Application No. 2014-010216, filed Jan. 23, 2014. The contents of this application are incorporated herein by reference in their entirety.

BACKGROUND

The present disclosure relates a toner and a method of manufacturing the same, and in particular relates to a capsule toner and a method of manufacturing the same.

A capsule toner includes toner particles that each include a core and a shell layer (capsule layer) disposed over the surface of the core. For example, in a known method of manufacturing a capsule toner, shell layers are formed using resin particles (specifically, acrylic resin particles) having a Martens hardness of at least 120 $N/mm^2$ and no greater than 180 $N/mm^2$.

SUMMARY

A toner according to the present disclosure includes a plurality of toner particles that each include a core and a shell layer disposed over a surface of the core. The shell layer contains a unit derived from a thermoplastic resin and a unit derived from a monomer or prepolymer of a thermosetting resin. A surface of each of the toner particles has a Young's modulus that when measured in a state in which an external additive is not adhered to the the toner particle using a scanning probe microscope while raising a cantilever temperature thereof, the Young's modulus changes by a proportion of no greater than 20% from 30° C. to 50° C. Also, the Young's modulus changes by a proportion from 50° C. to 70° C. that when divided by the proportion of change from 30° C. to 50° C., yields a value of at least 3.0 and no greater than 10.0.

A method of manufacturing a toner according to the present disclosure includes forming a plurality of cores, adding, to a liquid, at least the cores, a material for forming a unit derived from a thermoplastic resin, and a material for forming a unit derived from a monomer or prepolymer of a thermosetting resin, and forming, over a surface of each of the cores, a shell layer containing the unit derived from the thermoplastic resin and the unit derived from the monomer or prepolymer of the thermosetting resin. A Young's modulus of a surface of the shell layer is adjusted based on a ratio of an additive amount of the material for forming the unit derived from the monomer or prepolymer of the thermosetting resin relative to an additive amount of the material for forming the unit derived from the thermoplastic resin.

DETAILED DESCRIPTION

The following explains an embodiment of the present disclosure.

A toner according to the present embodiment is a capsule toner for developing an electrostatic charge image. The toner according to the present embodiment is for example suitable for use as a positively chargeable toner for developing an electrostatic charge image. The toner according to the present embodiment is a powder including a large number of particles (herein referred to as toner particles). The toner may be used as a one-component developer. Alternatively, the toner may be mixed with a carrier using a mixer (for example, a ball mill) in order to prepare a two-component developer. The toner according to the present embodiment can for example be used in an electrophotographic apparatus (image forming apparatus).

The following explains an example of an image forming method performed by the electrophotographic apparatus. First, an electrostatic charge image is formed on a photosensitive body based on image data. Next, the formed electrostatic charge is developed using a developer containing the toner. In the development process, charged toner is caused to adhere to the electrostatic charge image. After the adhered toner has been transferred onto a transfer belt as a toner image, the toner image on the transfer belt is transferred onto a recording medium (for example, paper). The toner is subsequently fixed to the recording medium through heating. As a result of the above process, an image is formed on the recording medium. A full-color image can for example be formed by superposing toner images of four different colors: black, yellow, magenta, and cyan.

Figure 1:
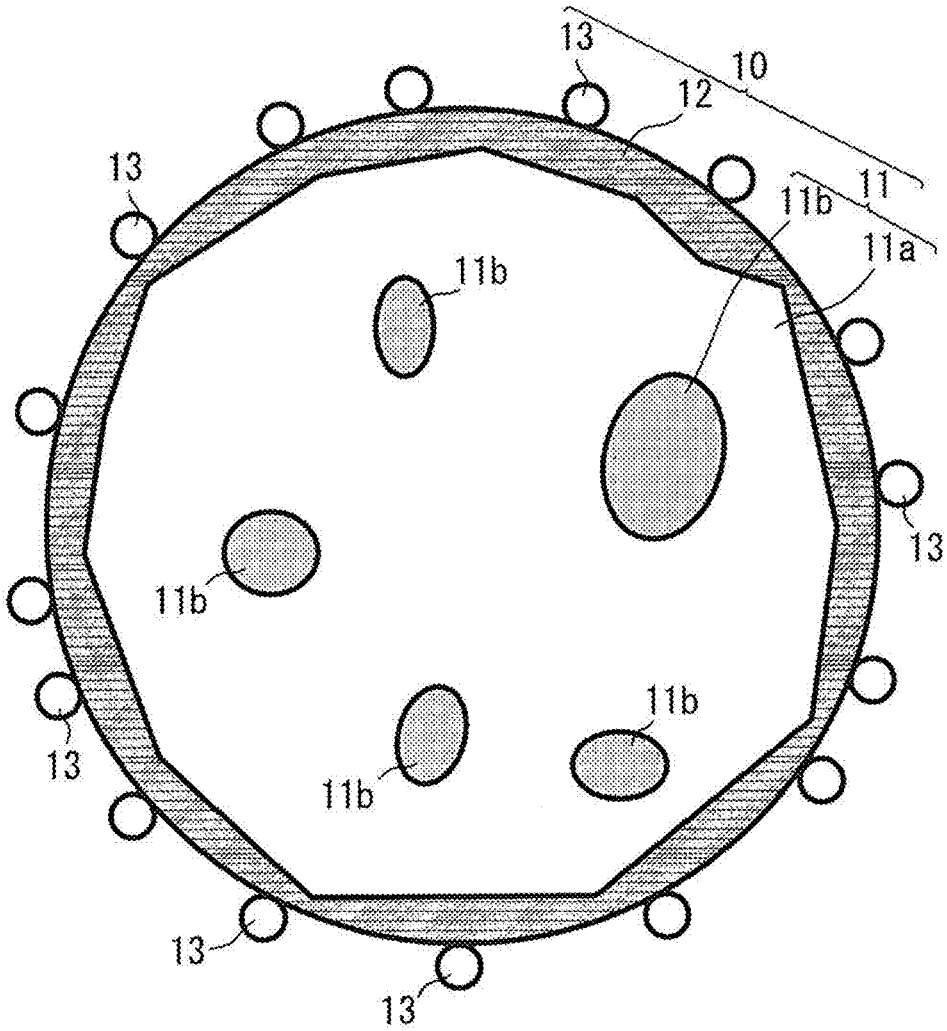
FIG. 1 illustrates a toner particle included in a toner according to an embodiment of the present disclosure.

The following explains the composition of the toner (in particular, the toner particles) according to the present embodiment with reference to FIG. 1. FIG. 1 illustrates a toner particle 10 included in the toner according to the present embodiment.

As illustrated in FIG. 1, the toner particle 10 includes a core 11, a shell layer (capsule layer) 12 disposed over the surface of the core 11, and an external additive 13. Herein, particles that are yet to be subjected to external addition (i.e., toner particles that do not include an adhered external additive) are referred to as toner mother particles.

The core 11 contains a binder resin 11*a* and internal additives 11*b* (for example, a colorant and a releasing agent). The shell layer 12 coats the core 11. The external additive 13 adheres to the surface of the shell layer 12. Note that the internal additives 11*b* and the external additive 13 may be omitted if such additives are unnecessary. Also, a plurality of shell layers 12 may be layered over the surface of the core 11.

In the toner according to the present embodiment, the surface of the toner particle 10 has a Young's modulus that satisfies conditions (1) and (2) shown below when measured in a state in which no external additive is adhered (i.e., when measured as a toner mother particle) using a scanning probe microscope (SPM) while raising the temperature of a cantilever of the SPM.

(1) The Young's modulus of the toner mother particle changes by a proportion of no greater than 20.0% from 30° C. to 50° C.

(2) The Young's modulus of the toner mother particle changes by a proportion from 50° C. to 70° C. that when divided by the proportion of change of the Young's modulus of the toner mother particle from 30° C. to 50° C. yields a value of at least 3.0 and no greater than 10.0.

The toner according to the present embodiment includes toner particles 10 that satisfy conditions (1) and (2) (herein referred to as toner particles 10 according to the present embodiment).

As a result of the toner particles 10 each satisfying condition (1), the Young's modulus of the toner particles 10 changes by a small proportion at standard ambient temperatures (i.e., in a temperature range from 30° C. to 50° C.). Consequently, the toner (in particular, the shell layers 12) is less readily ruptured during storage or transportation of the toner.

As a result of the toner particles 10 each satisfying condition (2), the Young's modulus of the toner particles 10 changes by a proportion at high ambient temperatures (i.e., in a temperature range from 50° C. to 70° C.) that is at least 3 times higher than the proportion of change at standard ambient temperatures (temperature range from 30° C. to 50° C.). The above indicates that the shell layers 12 become more readily ruptured upon heating. Therefore, the toner can be fixed to a recording medium at low fixing temperatures. In the present embodiment, the Young's modulus of the toner particles 10 changes by a proportion at high ambient temperatures (temperature range from 50° C. to 70° C.) that is no greater than 10 times higher than the proportion of change at standard ambient temperatures (temperature range from 30° C. to 50° C.). As a result, the toner particles 10 according to the present embodiment have high heat resistance and mechanical strength that ensure sufficient preservability.

As described above, the toner including the toner particles 10 according to the present embodiment has excellent properties in terms of both high-temperature preservability and low-temperature fixability. Among toner particles included in the toner, preferably at least 80% by number are toner particles 10 according to the present embodiment, more preferably at least 90% by number are toner particles 10 according to the present embodiment, and particularly preferably 100% by number are toner particles 10 according to the present embodiment.

In order to improve high-temperature preservability and low-temperature fixability of the toner, the Young's modulus of the surface of the toner mother particles when measured using the SPM while the cantilever temperature thereof is 30° C., is preferably at least 2.00 GPa and no greater than 4.50 GPa, and more preferably at least 3.00 GPa and no greater than 4.00 GPa.

The cores 11 are preferably anionic. A material of the shell layers 12 (herein referred to as a shell material) is preferably cationic. As a result of the cores 11 being anionic, the cationic shell material can be attracted toward the surface of the cores 11 during formation of the shell layers 12. More specifically, it is thought that the shell material which has a positive charge in an aqueous medium is attracted toward the cores 11 which have a negative charge in the aqueous medium and the shell layers 12 are formed over the surface of the cores 11, for example, by in-situ polymerization. As a consequence of the shell material being attracted toward the cores 11, it is thought that the shell layers 12 can be readily formed in a uniform manner over the surface of the cores 11 without needing to use a dispersant in order to achieve a high degree of dispersion of the cores 11 in the aqueous medium.

The cores 11 having a negative zeta potential (i.e., less than 0 V) measured in an aqueous medium adjusted to pH 4 (herein referred to simply as a zeta potential at pH 4) is an indicator that the cores 11 are anionic. In order that the cores 11 and the shell layers 12 bond more strongly to one another, the cores 11 preferably have a zeta potential at pH 4 of less than 0 V and the toner particles 10 preferably have a zeta potential at pH 4 of greater than 0 V. Note that pH 4 corresponds to the pH of the aqueous medium during formation of the shell layers 12 in the present embodiment.

Examples of methods for measuring the zeta potential include an electrophoresis method, an ultrasound method, and an electric sonic amplitude (ESA) method.

The electrophoresis method involves applying an electrical field to a liquid dispersion of particles, thereby causing electrophoresis of charged particles in the dispersion, and measuring the zeta potential based on the rate of electrophoresis. An example of the electrophoresis method is laser Doppler electrophoresis in which migrating particles are irradiated with laser light and the rate of electrophoresis of the particles is calculated from an amount of Doppler shift of scattered light that is obtained. Advantages of laser Doppler electrophoresis are a lack of necessity for particle concentration in the dispersion to be high, a low number of parameters being necessary for calculating the zeta potential, and a good degree of sensitivity in detection of the rate of electrophoresis.

The ultrasound method involves irradiating a liquid dispersion of particles with ultrasound, thereby causing vibration of electrically charged particles in the dispersion, and measuring the zeta potential based on an electric potential difference that arises due to the vibration.

The ESA method involves applying a high frequency voltage to a liquid dispersion of particles, thereby causing electrically charged particles in the dispersion to vibrate and generate ultrasound. The zeta potential is then measured based on the magnitude (intensity) of the ultrasound.

An advantage of the ultrasound method and the ESA method is that the zeta potential can be measured to a good degree of sensitivity even when particle concentration of the dispersion is high (for example, exceeding 20% by mass). In order to reduce the effluent load, a dispersant (surfactant) is preferably not used in either formation of the cores 11 or formation of the shell layers 12. Dispersants typically have a high effluent load. In a configuration in which a dispersant is not used, the amount of water used during a washing process can be reduced. Also, in a configuration in which a dispersant is not used, the total organic carbon (TOC) concentration of effluent discharged during manufacture of the toner particles 10 can be restricted to a low level of no greater than 15 mg/L without diluting the effluent.

The organic component (for example, unreacted monomer, prepolymer, or dispersant) of an effluent can be measured by measuring biochemical oxygen demand (BOD), chemical oxygen demand (COD), or TOC concentration. Among the above methods of measuring organic content, measurement based on the TOC concentration enables reliable measurement of all organic substances. Also, by measuring the TOC concentration, the amount of organic component in the effluent (i.e., filtrates after washing) which does not contribute to capsulation (i.e., formation of the shell layers 12) can be determined The following explains, in order, the cores 11 (binder resin 11*a* and internal additives 11*b*), the shell layers 12, and the external additive 13. Note that herein the term "(meth) acrylic" is used as a generic term for both acrylic and methacrylic.

[Cores]

The cores 11 contain the binder resin 11*a*. The cores 11 may optionally contain one or more internal additives 11*b* (a colorant, a releasing agent, a charge control agent, and a magnetic powder). However, non-essential components (for example, the colorant, the releasing agent, the charge control agent, and the magnetic powder) may be omitted in accordance with intended use of the toner.

[Binder Resin (Cores)]

The binder resin 11*a* constitutes a large proportion (for example, at least 85% by mass) of components contained in the cores 11. Therefore, the polarity of the binder resin 11*a* has a significant influence on the overall polarity of the cores 11. For example, when the binder resin 11*a* has an ester group, a hydroxyl group, an ether group, an acid group, or a methyl group, the cores 11 tend to be anionic. On the other hand, when the binder resin 11*a* for example has an amino group, an amine, or an amide group, the cores 11 tend to be cationic.

In order that the binder resin 11*a* is strongly anionic, the binder resin 11*a* preferably has a hydroxyl value (measured according to Japanese Industrial Standard (JIS) K-0070) and an acid value (measured according to JIS K-0070) that are each at least 10 mg KOH/g, and more preferably at least 20 mg KOH/g.

The glass transition point (Tg) of the binder resin 11*a* is preferably no greater than a curing initiation temperature of the shell material. As a result of the binder resin 11*a* having a Tg such as described above, the toner can be fixed more readily at low temperatures, even during high speed fixing. A curing reaction to form a melamine resin in an aqueous medium (i.e., a reaction of melamine monomers) typically occurs rapidly at 50° C. or higher when the aqueous medium has an acidic pH of 4. In a composition in which the shell layers 12 contain a melamine resin, Tg of the binder resin 11*a* is preferably close to a reaction temperature (50° C.) of melamine monomers. More specifically, Tg of the binder resin 11*a* is preferably at least 20° C. and no greater than 55° C. During manufacture of a toner having a composition such as described above, shell layers 12 that are hard and thin can be easily formed over the surface of the cores 11 in an aqueous medium while controlling shape of particles through surface tension of the binder resin 11*a*.

The binder resin 11*a* preferably has a softening point (Tm) of no greater than 105° C., and more preferably no greater than 95° C. As a result of Tm of the binder resin 11*a* being no greater than 105° C. (more preferably no greater than 95° C.), it is thought that the toner can be more readily fixed at low temperatures, even during high speed fixing. Also, as a result of Tm of the binder resin 11*a* being no greater than 105° C. (more preferably no greater than 95° C.), the cores 11 are partially softened while a curing reaction of the shell layers 12 occurs during formation of the shell layers 12 on the surface of the cores 11 in an aqueous medium, thereby causing spheroidizing of the cores 11 due to surface tension. Note that Tm of the binder resin 11*a* can be adjusted by combining, as the binder resin 11*a*, a plurality of resins that each have a different Tm.

Figure 2:
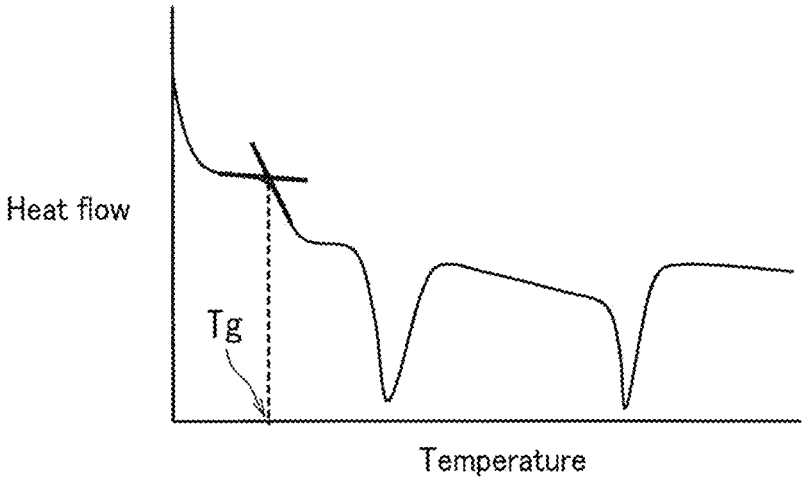
FIG. 2 illustrates a method of reading a glass transition point from a heat absorption curve.

The following explains a method of reading Tg of the binder resin 11*a* from a heat absorption curve with reference to FIG. 2. FIG. 2 is a graph illustrating an example of a heat absorption curve.

The glass transition point (Tg) of the binder resin 11*a* can be measured according to the method described below. A heat absorption curve of the binder resin 11*a* can be plotted using a differential scanning calorimeter (for example, a DSC-6220 produced by Seiko Instruments Inc.). FIG. 2 illustrates an example of the heat absorption curve which is plotted. The glass transition point (Tg) of the binder resin 11*a* can be calculated from the heat absorption curve that is plotted (more specifically, from a point of change of specific heat of the binder resin 11*a*).

Figure 3:
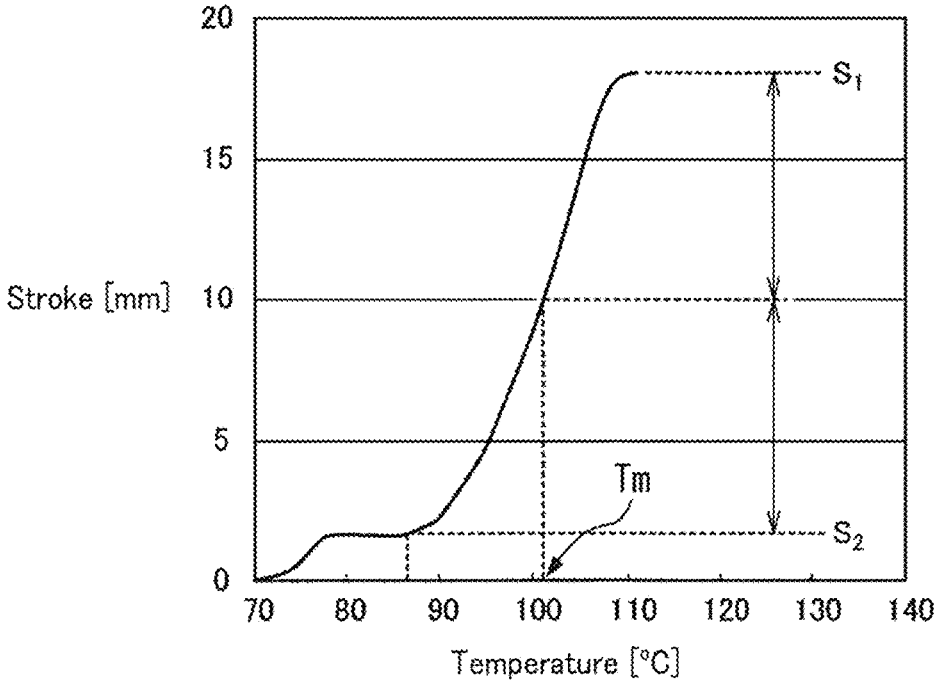
FIG. 3 illustrates a method of reading a softening point from an S-shaped curve.

The following explains a method of reading Tm of the binder resin 11*a* from an S-shaped curve with reference to FIG. 3. FIG. 3 is a graph illustrating an example of an S-shaped curve.

The softening point (Tm) of the binder resin 11*a* can be measured according to the method described below. The softening point (Tm) of the binder resin 11*a* can be measured using a capillary rheometer (for example, a CFT-500D produced by Shimadzu Corporation). For example, the binder resin 11*a* (measurement sample) is placed in the capillary rheometer and melt-flow of the measurement sample is caused under specific conditions in order to plot an S-shaped curve of stroke (mm)/temperature (° C.). Tm of the binder resin 11*a* can be read from the S-shaped curve that is plotted. In FIG. 3, $S_1$ indicates a maximum stroke value and $S_2$ indicates a base line stroke value at low temperatures. Tm of the measurement sample is equivalent to a temperature along the S-shaped curve at which the stroke value is $(S_1+S_2)/2$.

The following continues explanation of the binder resin 11*a* shown in FIG. 1. The binder resin 11*a* preferably has a functional group such as an ester group, a hydroxyl group, an ether group, an acid group, a methyl group, or a carboxyl group in molecules thereof, and more preferably has either or both of a hydroxyl group and a carboxyl group in molecules thereof. As a result of the cores 11 (binder resin 11*a*) having a functional group such as described above, the cores 11 readily react with the shell material (for example, methylol melamine) to form chemical bonds. Formation of chemical bonds ensures that the cores 11 are strongly bound to the shell layers 12. Furthermore, the binder resin 11*a* preferably has an activated hydrogen-containing functional group in molecules thereof.

The binder resin 11*a* is preferably a thermoplastic resin. Preferable examples of thermoplastic resins that can be used as the binder resin 11*a* include styrene-based resins, acrylic-based resins, styrene-acrylic-based resins, polyethylene-based resins, polypropylene-based resins, vinyl chloride-based resins, polyester resins, polyamide-based resins, urethane-based resins, polyvinyl alcohol-based resins, vinyl ether-based resins, N-vinyl-based resins, and styrene-butadiene-based resins. Among the resins listed above, styrene-acrylic-based resins and polyester resins are preferable in terms of improving colorant dispersibility in the toner, chargeability of the toner, and fixability of the toner to a recording medium. Low-temperature fixability of the toner can be improved by including crystalline polyester in the binder resin 11*a*.

(Styrene-Acrylic-Based Resins)

A styrene-acrylic-based resin is a copolymer of a styrene-based monomer and an acrylic-based monomer.

Preferable examples of styrene-based monomers that can be used in preparation of the styrene-acrylic-based resin (binder resin 11*a*) include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of acrylic-based monomers that can be used in preparation of the styrene-acrylic-based resin (binder resin 11*a*) include (meth)acrylic acid, alkyl (meth) acrylates, and hydroxyalkyl (meth)acrylates. Specific examples of preferable alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Specific examples of preferable hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth)acrylate.

A hydroxyl group can be introduced into the styrene-acrylic-based resin by using a hydroxyl group-containing monomer (for example, p-hydroxystyrene, m-hydroxystyrene, or a hydroxyalkyl (meth)acrylate) during preparation of the styrene-acrylic-based resin. The hydroxyl value of the styrene-acrylic-based resin which is prepared can be adjusted through adjustment of the amount of the hydroxyl group-containing monomer used during preparation of the styrene-acrylic-based resin.

A carboxyl group can be introduced into the styrene-acrylic-based resin by using (meth)acrylic acid (monomer) during preparation of the styrene-acrylic-based resin. The acid value of the styrene-acrylic-based resin which is prepared can be adjusted through adjustment of the amount of the (meth)acrylic acid used during preparation of the styrene-acrylic-based resin.

In a composition in which the binder resin 11*a* is a styrene-acrylic-based resin, the styrene-acrylic-based resin preferably has a number average molecular weight (Mn) of at least 2,000 and no greater than 3,000 in order to improve strength of the cores 11 and fixability of the toner. Also, the styrene-acrylic-based resin preferably has a molecular weight distribution (i.e., a ratio Mw/Mn of mass average molecular weight (Mw) relative to number average molecular weight (Mn)) of at least 10 and no greater than 20. Mn and Mw of the styrene-acrylic-based resin can be measured by gel permeation chromatography.

(Polyester Resins)

The polyester resin used as the binder resin 11*a* is for example prepared through condensation polymerization or condensation copolymerization of a di-, tri-, or higher-hydric alcohol and a di-, tri-, or higher-basic carboxylic acid.

In a composition in which the binder resin 11*a* is a polyester resin, preferable examples of alcohols that can be used in preparation of the polyester resin include diols, bisphenols, and tri- or higher-hydric alcohols such as described below.

Specific examples of preferable diols that can be used in preparation of the polyester resin include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Specific examples of preferable bisphenols that can be used in preparation of the polyester resin include bisphenol A, hydrogenated bisphenol A, polyoxyethylenated bisphenol A, and polyoxypropylenated bisphenol A.

Specific examples of preferable tri- or higher-hydric alcohols that can be used in preparation of the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

In a composition in which the binder resin 11*a* is a polyester resin, preferable examples of carboxylic acids that can be used in preparation of the polyester resin include di-, tri-, and higher-basic carboxylic acids such as described below.

Specific examples of preferable di-basic carboxylic acids that can be used in preparation of the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (more specifically, n-butylsuccinic acid, isobutylsuccinic acid, n-octylsuccinic acid, n-dodecylsuccinic acid, and isododecylsuccinic acid), and alkenyl succinic acids (more specifically, n-butenylsuccinic acid, isobutenylsuccinic acid, n-octenylsuccinic acid, n-dodecenylsuccinic acid, and isododecenylsuccinic acid).

Specific examples of tri- or higher-basic carboxylic acids that can be used in preparation of the polyester resin include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3 -dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Alternatively, an ester-forming derivative (acid halide, acid anhydride, or lower alkyl ester) of any of the di-, tri-, or higher-basic carboxylic acids listed above may be used. Herein, the term lower alkyl refers to an alkyl group having 1 to 6 carbon atoms.

The acid value and the hydroxyl value of the polyester resin can be adjusted through adjustment of the amount of the di-, tri-, or higher-hydric alcohol and the amount of the di-, tri-, or higher-basic carboxylic acid used during preparation of the polyester resin. Increasing the molecular weight of the polyester resin tends to decrease the acid value and the hydroxyl value of the polyester resin.

In a composition in which the binder resin 11*a* is a polyester resin, the polyester resin preferably has a number average molecular weight (Mn) of at least 1,200 and no greater than 2,000 in order to improve strength of the cores 11 and fixability of the toner. Also, the polyester resin preferably has a molecular weight distribution (i.e., a ratio Mw/Mn of mass average molecular weight (Mw) relative to number average molecular weight (Mn)) of at least 9 and no greater than 20. Mn and Mw of the polyester resin can be measured by gel permeation chromatography.

[Colorant (Cores)]

The cores 11 may optionally contain a colorant as an internal additive 11*b*. The colorant can be a commonly known pigment or dye that matches the color of the toner. The amount of the colorant is preferably at least 1 part by mass and no greater than 20 parts by mass relative to 100 parts by mass of the binder resin 11*a*, and more preferably at least 3 parts by mass and no greater than 10 parts by mass.

(Black Colorants)

The cores 11 may optionally contain a black colorant. The black colorant is for example carbon black. Alternatively, a colorant may be used that has been adjusted to a black color using colorants such as a yellow colorant, a magenta colorant, and a cyan colorant.

(Non-Black Colorants)

The cores 11 may optionally contain a non-black colorant such as a yellow colorant, a magenta colorant, or a cyan colorant.

Examples of yellow colorants include condensed azo compounds, isoindolinone compounds, anthraquinone compounds, azo metal complexes, methine compounds, and arylamide compounds. Specific examples of preferable yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of preferable magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants include copper phthalocyanine compounds, copper phthalocyanine derivatives, anthraquinone compounds, and basic dye lake compounds. Specific examples of preferable cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

[Releasing Agent (Cores)]

The cores 11 may optionally contain a releasing agent as an internal additive 11*b*. The releasing agent is for example used in order to improve fixability or offset resistance of the toner. In order to improve fixibility or offset resistance of the toner, the amount of the releasing agent is preferably at least 1 part by mass and no greater than 30 parts by mass relative to 100 parts by mass of the binder resin 11*a*, and more preferably at least 5 parts by mass and no greater than 20 parts by mass.

Examples of preferable releasing agents include: aliphatic hydrocarbon-based waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozocerite, ceresin, and petrolatum; waxes having a fatty acid ester as major component such as montanic acid ester wax and castor wax; and waxes in which a part or all of a fatty acid ester has been deoxidized such as deoxidized carnauba wax.

[Charge Control Agent (Cores)]

The cores 11 may optionally contain a charge control agent as an internal additive 11*b*. The charge control agent is for example used in order to improve charge stability or a charge rise characteristic of the toner. The charge rise characteristic is an indicator of whether or not the toner can be charged to a specific charge level in a short period of time.

[Magnetic Powder (Cores)]

The cores 11 may optionally contain a magnetic powder as an internal additive 11*b*. Preferable examples of a material of the magnetic powder include iron (more specifically, ferrite and magnetite), ferromagnetic metals (more specifically, cobalt and nickel), alloys containing either or both of iron and a ferromagnetic metal, ferromagnetic alloys subjected to ferromagnetization such as heat treatment, and chromium dioxide.

The magnetic powder is preferably subjected to surface treatment in order to inhibit elution of iron ions from the magnetic powder. In a situation in which the shell layers 12 are formed on the surface of the cores 11 under acidic conditions, elution of iron ions to the surface of the cores 11 causes the cores 11 to adhere to one another more readily. Inhibiting elution of iron ions from the magnetic powder thereby inhibits the cores 11 from adhering to one another.

[Shell Layers]

The shell layers 12 contain a unit derived from a thermoplastic resin and a unit derived from a monomer or prepolymer of a thermosetting resin. For example, the unit derived from the thermoplastic resin is cross-linked by the unit derived from the monomer or prepolymer of the thermosetting resin. The shell layers 12 such as described above are thought to have suitable flexibility due to the thermoplastic resin and suitable mechanical strength due to the three-dimensional cross-linking structure formed by the monomer or prepolymer of the thermosetting resin. Therefore, a toner including the toner particles 10 that each include a shell layer 12 such as described above is considered to have excellent high-temperature preservability and low-temperature fixability. More specifically, the shell layers 12 are not readily ruptured during storage or transport of the toner. On the other hand, during fixing of the toner, the shell layers 12 are readily ruptured due to application of heat and pressure, and softening or melting of the cores 11 (for example, the binder resin 11*a*) proceeds rapidly. Therefore, the toner can be fixed to a recording medium at low temperatures. In order to improve high-temperature preservability and low-temperature fixability of the toner, the shell layers 12 are preferably essentially composed of the unit derived from the thermoplastic resin and the unit derived from the monomer or prepolymer of the thermosetting resin.

Note that the unit derived from the thermoplastic resin (herein referred to as a thermoplastic unit) may be a unit that is modified, for example by introduction of a functional group, oxidation, reduction, or substitution of atoms, without drastically changing the structure or properties of the base thermoplastic resin. The thermoplastic unit preferably has a reactive functional group containing activated hydrogen.

The unit derived from the monomer or prepolymer of the thermosetting resin (herein referred to as a thermosetting unit) may be a unit that is modified, for example by introduction of a functional group, oxidation, reduction, or substitution of atoms, without drastically changing the structure or properties of the base monomer or prepolymer of the thermosetting resin. The thermosetting unit preferably has a functional group that exhibits a high degree of adhesion toward the cores 11 and a functional group that can control charge polarity.

During formation of the shell layers 12 over the surface of the cores 11 through in-situ polymerization, the thermoplastic unit is taken into the shell layers 12 (condensation films) at the same time as the polymerization, enabling the shell layers 12 to be readily formed over the surface of the cores 11 in a uniform manner.

The thermosetting resin is readily chargeable to a strong positive charge. In the toner according to the present embodiment, as a result of the shell layers 12 containing the thermoplastic unit in addition to the thermosetting unit, the charge of the toner can be easily adjusted to within a desired range. Note that the shell layers 12 may for example optionally contain a positively chargeable charge control agent.

In order to inhibit dissolution of the binder resin 11*a* or elution of the releasing agent during formation of the shell layers 12, the formation of the shell layers 12 is preferably carried out in an aqueous medium. Therefore, the shell material is preferably water-soluble.

The thermoplastic resin relating to the thermoplastic unit preferably has a functional group that readily reacts with a functional group of the thermosetting resin (for example, a methylol group or an amino group). For example, the thermoplastic resin relating to the thermoplastic unit preferably has a reactive functional group containing activated hydrogen (for example, a hydroxyl group, a carboxyl group, or an amino group). The amino group may be present in the thermoplastic resin in the form of a carbamoyl group (—$CONH_2$). The thermoplastic resin relating to the thermoplastic unit preferably has a carbodiimide group, an oxazoline group, or a glycidyl group. For example, the shell layers 12 may be formed using a cross-linking agent that has a carbodiimide group.

The thermoplastic unit preferably contains an acrylic component and more preferably contains a reactive acrylate. The thermoplastic unit containing the acrylic component is thought to readily react with the thermosetting resin, thereby enabling improved film quality of the shell layers 12. It is particularly preferable that the thermoplastic unit contains 2HEMA (2-hydroxyethyl methacrylate).

Specific examples of the thermoplastic resin relating to the thermoplastic unit include acrylic-based resins, styrene-acrylic-based copolymers, silicone-acrylic-based graft copolymers, urethane resins, polyester resins, and ethylene vinyl alcohol copolymers. The thermoplastic resin relating to the thermoplastic unit is preferably an acrylic-based resin, a styrene-acrylic-based copolymer, or a silicone-acrylic-based graft copolymer, with an acrylic-based resin being particularly preferable. Inclusion of a silicone-acrylic-based graft copolymer in the shell layers 12 can improve water resistance of the shell layers 12.

Among the above-listed thermoplastic resins relating to the thermoplastic unit, preferable examples of thermoplastic resins that are water-soluble include polyvinyl alcohol resins, polyvinylpyrrolidone, carboxymethyl cellulose (or a derivative thereof), sodium polyacrylate, polyacrylamide, polyethylenimine, and polyethylene oxide. Also, the thermoplastic resin is preferably a water-soluble resin derived from a monomer having a polar functional group (for example, a glycol, a carboxylic acid, or maleic acid). The thermoplastic resin having a polar functional group has a high reactivity.

Examples of acrylic-based monomers that can be used in preparation of the acrylic-based resin include: alkyl (meth) acrylates such as methyl (meth)acrylate, ethyl (meth)acrylate, n-propyl (meth)acrylate, and n-butyl (meth)acrylate; aryl (meth)acrylates such as phenyl (meth)acrylate; hydroxyalkyl (meth)acrylates such as 2-hydroxyethyl (meth)acrylate, 3-hydroxypropyl (meth)acrylate, 2-hydroxypropyl (meth)acrylate, and 4-hydroxybutyl (meth) acrylate; (meth)acrylamide; ethylene oxide adduct of (meth) acrylic acid; and alkyl ethers, such as methyl ether, ethyl ether, n-propyl ether, and n-butyl ether, of ethylene oxide adducts of (meth)acrylic acid esters.

The thermoplastic unit may be formed using a water-soluble resin, using a liquid dispersion of oily fine particles dispersed in water as a suspension, or using a silane coupling agent.

The thermosetting resin relating to the thermosetting unit is preferably a melamine resin, a urea resin, a sulfonamide resin, a glyoxal resin, a guanamine resin, an aniline resin, a polyimide resin, or a derivative of any of the aforementioned resins. A polyimide resin contains nitrogen in a molecular framework thereof. As a consequence, shell layers 12 containing a polyimide resin tend to be strongly cationic. Preferable examples of polyimide resins that may be contained in the shell layers 12 include maleimide-based polymers and bismaleimide-based polymers (for example, amino-bismaleimide polymers and bismaleimide triazine polymers).

In particular, the thermosetting resin relating to the thermosetting unit is preferably a resin generated by polycondensation of an aldehyde (for example, formaldehyde) and a compound containing an amino group. Note that a melamine resin is a polycondensate of melamine and formaldehyde. A urea resin is a polycondensate of urea and formaldehyde. A glyoxal resin is a polycondensate of formaldehyde and a reaction product of glyoxal and urea.

Inclusion of nitrogen in the thermosetting resin enables the thermosetting resin to perform a function of cross-link curing more effectively. In order that the thermosetting resin has a high reactivity, the amount of nitrogen contained therein is preferably adjusted to be at least 40% by mass and no greater than 55% by mass in the case of a melamine resin, approximately 40% by mass in the case of a urea resin, and approximately 15% by mass in the case of a glyoxal resin.

The thermosetting unit can be prepared using at least one monomer (shell material) selected from the group consisting of methylol melamine, melamine, methylol urea (for example, dimethylol dihydroxyethyleneurea), urea, benzoguanamine, acetoguanamine, and spiroguanamine The shell material preferably dissolves or disperses in water. A curing agent or a reaction accelerator may also be used in formation of the shell layers 12.

The shell layers 12 preferably have a thickness of at least 1 nm and no greater than 20 nm, and more preferably at least 1 nm and no greater than 10 nm However, it is not essential that there is a clear interface between the cores 11 and the shell layers 12. Alternatively, shell layers 12 integrated with cores 11 may gradually change in terms of properties toward becoming a surface layer.

As a result of the thickness of the shell layers 12 being no greater than 20 nm, the shell layers 12 are readily ruptured due to application of heat and pressure during fixing of the toner to a recording medium. Therefore, softening or melting of the binder resin 11*a* and the releasing agent contained in the cores 11 proceeds rapidly, enabling fixing of the toner to the recording medium at low temperatures. Also, as a result of the thickness of the shell layers 12 being no greater than 20 nm, chargeability of the shell layers 12 can be restricted from becoming excessively strong. Therefore, an image having high image quality can be more easily formed using the toner.

On the other hand, as a result of the thickness of the shell layers 12 being at least 1 nm, the shell layers 12 tend to have sufficient strength. Therefore, rupturing of the shell layers 12 during transport, for example due to impact, can be inhibited, thereby improving preservability of the toner.

The thickness of the shell layers 12 of the target toner particles 10 can be measured by analyzing cross-sectional transmission electron microscopy (TEM) images of the toner particles 10 using commercially available image analysis software (for example, WinROOF produced by Mitani Corporation). Note that if the thickness of the shell layer 12 is not uniform for a single toner particle, the thickness of the shell layer 12 is measured at each of four locations that are approximately evenly spaced and the arithmetic mean of the four measured values is determined to be an evaluation value (thickness of shell layer 12) for the toner particle. More specifically, the four measurement locations are determined by drawing two straight lines that intersect at right angles at approximately the center of the cross-section and by determining four locations at which the straight lines and the shell layer intersect to be the measurement locations.

The shell layers 12 may have fractures therein (i.e., portions having low mechanical strength). The fractures can be formed by causing localized defects to occur in the shell layers 12. Formation of the fractures in the shell layers 12 enables the shell layers 12 to be ruptured more readily. Therefore, the toner can be fixed to a recording medium at low temperatures. Any appropriate number of fractures may be present in the shell layers 12.

[External Additive]

The external additive 13 is for example used in order to improve fluidity or handleability of the toner. In order to improve fluidity or handleability of the toner, the amount of the external additive 13 is preferably at least 0.5 parts by mass and no greater than 10 parts by mass relative to 100 parts by mass of the toner mother particles, and more preferably at least 2 parts by mass and no greater than 5 parts by mass.

The external additive 13 is for example composed of particles of silica or particles of a metal oxide (for example, alumina, titanium oxide, magnesium oxide, zinc oxide, strontium titanate, or barium titanate).

In order to improve fluidity or handleability of the toner, the external additive 13 preferably has a particle diameter of at least 0.01 nm and no greater than 1.0 μm.

[Toner Manufacturing Method]

The following explains a toner manufacturing method according to the present embodiment. The toner manufacturing method according to the present embodiment includes forming a plurality of cores 11. Next, at least the cores 11, a material for forming a thermoplastic unit, and a material for forming a thermosetting unit are added to a liquid. Next, shell layers 12 containing the thermoplastic unit and the thermosetting unit are formed over the surface of the cores 11 in the liquid. The Young's modulus of the surface of the shell layers 12 that are formed on the surface of the cores 11 is adjusted based on a ratio of the additive amount of the material for forming the thermosetting unit relative to the additive amount of the material for forming the thermoplastic unit.

The toner manufacturing method according to the present embodiment facilitates manufacture of a toner having good high-temperature preservability and low-temperature fixability.

The following further explains the toner manufacturing method according to the present embodiment based on a specific example. For example, first ion exchanged water is prepared as the aforementioned liquid. Next, the pH of the liquid is adjusted using, for example, hydrochloric acid. A shell material (i.e., a material for forming a thermoplastic unit and a material for forming a thermosetting unit) is subsequently added to the liquid. The shell material is dissolved in the liquid to obtain a solution. An appropriate additive amount of the shell material can be calculated based on the specific surface area of the cores 11. Addition of the shell material is for example performed at room temperature. The temperature of the liquid can be used to control the molecular weight of the shell layers 12 (polycondensation films).

Next, the cores 11 are added to the resultant solution and the solution is heated while stirring. For example, the solution may be heated to 70° C. over 30 minutes at a heating rate of 1° C./minute. As a result, the shell material adheres to the surface of the cores 11 and hardens while adhered thereto by undergoing a polymerization reaction. The cores 11 can for example be prepared according to a dry pulverization process, a dissolution-suspension granulation process, or a high-pressure emulsification process.

The cores 11 transform in terms of shape if the temperature of the solution becomes equal to or greater than the glass transition point (Tg) of the cores 11. For example, in a situation in which Tg of the binder resin 11*a* of the cores 11 is 45° C. and the thermosetting unit contained in the shell layers 12 is a unit derived from a monomer or prepolymer of a melamine resin, heating of the solution to approximately 50° C. causes a curing reaction of the shell material (specifically, the material for forming the thermosetting unit) to proceed rapidly and the cores 11 to transform in terms of shape. When the shell material is caused to react at high temperatures, hard films (shell layers 12) tend to be formed. Also, the cores 11 transform more readily in terms of shape with increasing temperature of the liquid, thereby tending to yield toner mother particles that are more spherical. Therefore, preferably the reaction temperature is determined in order to obtain toner mother particles of a desired shape.

Next, the solution is neutralized. The neutralized solution is subsequently cooled. Once cooled, the solution is filtered. Through the above process, the toner mother particles are separated from the liquid (solid-liquid separation). Next, the toner mother particles that have been separated are dried. An external additive 13 is subsequently caused to adhere to the surface of the toner mother particles. The above completes the manufacture of a toner including a large number of toner particles 10.

The toner manufacturing method described above can be altered in accordance with intended composition, properties, or the like of the toner. For example, the cores 11 may be added to the solvent prior to dissolving the shell material in the solvent, or the shell material and the cores 11 may be added to the solvent at the same time. Also, the shell material may be added to the solvent as a single addition or may be divided up and added to the solvent as a plurality of additions. The shell layers 12 may be formed according to any appropriate process. For example, the shell layers 12 may be formed according to an in-situ polymerization process, an in-liquid curing film coating process, or a coacervation process. Also, the toner may be sifted after external addition. Note that non-essential processes may alternatively be omitted. In a process in which an external additive is not caused to adhere to the surface of the toner mother particles (i.e., a process in which external addition is omitted), the toner mother particles are equivalent to the toner particles. The material for forming the cores (herein referred to as a core material) and the shell material are not limited to the compounds (for example, monomers for forming resins) listed above. For example, alternatively a derivative of any of the compounds listed above may be used as the core material or the shell material in accordance with necessity thereof. Preferably a large number of the toner particles 10 are formed at the same time in order that the toner can be manufactured efficiently.

EXAMPLES

The following explains Examples of the present disclosure. Table 1 shows details of toners A-J (electrostatic charge image developing toners).

TABLE 1

| Toner | Shell material (relative additive amounts) | | Shell layer thickness (nm) |
|---|---|---|---|
| | Thermosetting resin | Thermoplastic resin | |
| Toner A | 1 | 1 | 10 |
| Toner B | 4 | 1 | 10 |
| Toner C | 1 | 4 | 10 |
| Toner D | 9 | 1 | 10 |
| Toner E | 1 | 9 | 10 |
| Toner F | 10 | 0 | 10 |

TABLE 1-continued

| Toner | Shell material (relative additive amounts) | | Shell layer thickness (nm) |
|---|---|---|---|
| | Thermosetting resin | Thermoplastic resin | |
| Toner G | 0 | 10 | — |
| Toner H | 3 | 4 | 10 |
| Toner I | 2 | 1 | 15 |
| Toner J | 1 | 1 | 10 |

The following explains, in order, a preparation method, an evaluation method, and evaluation results for each of toners A-J. Note that unless specifically stated, the evaluation results (for example, values indicating shape and physical properties) of the toners are number averages of values measured with respect to an appropriate number of particles.

[Preparation Method of Toner A]

(Core Preparation)

The following explains a procedure for preparing cores in the preparation method of toner A.

In the preparation method of toner A, the cores are prepared according to a pulverization and classification process. In the process of preparing the cores, 1,245 g of terephthalic acid, 1,245 g of isophthalic acid, 1,248 g of bisphenol A ethylene oxide adduct, and 744 g of ethylene glycol were added to a four-necked flask having a capacity of 5 L. The contents of the flask were caused to react for four hours at 220° C. under standard pressure. Next, 0.875 g of antimony trioxide, 0.548 g of triphenyl phosphate, and 0.102 g of tetrabutyl titanate were added to the flask. The internal pressure of the flask was subsequently reduced to 0.3 mmHg and the contents of the flask were caused to undergo a polycondensation reaction at 250° C.

Next, 30.0 g of trimellitic acid was added to the flask as a cross-linking agent. The contents of the flask were subsequently caused to react for one hour at 240° C. under standard pressure in an inert atmosphere. The above yielded a polyester resin having an Mn of 1,460, a hydroxyl value of 22.8 mg KOH/g (measured according to JIS K-0070), an acid value of 16.8 mg KOH/g (measured according to JIS K-0070), a Tm of 100.5° C., and a Tg of 53.8° C. The polyester resin had a ratio Mw/Mn (molecular weight distribution) of 12.7. Mw and Mn of the polyester resin were measured using a gel permeation chromatography (GPC) apparatus (HLC-8220GPC produced by Tosoh Corporation). Tm of the polyester resin was measured using a capillary rheometer (CFT-500D produced by Shimadzu Corporation). Tg of the polyester resin was measured using a differential scanning calorimeter (DSC-6220 produced by Seiko Instruments Inc.).

Next, 100 parts by mass of the polyester resin, 5 parts by mass of a colorant, and 5 parts by mass of a releasing agent were dry-mixed using a mixer (FM mixer produced by Nippon Coke & Engineering Co., Ltd.). C.I. Pigment Blue 15:3 (phthalocyanine pigment) was used as the colorant. An ester wax (WEP-3 produced by NOF Corporation) was used as the releasing agent.

The resultant mixture was kneaded using a twin screw extruder (PCM-30 produced by Ikegai Corp.). Next, the kneaded product (chip) was pulverized using a mechanical pulverizer (Turbo Mill produced by Freund-Turbo Corporation) set to a particle diameter of 5.6 μm. The pulverized product was classified using a classifier (Elbow Jet produced by Nittetsu Mining Co., Ltd.). Through the above process, cores having a median diameter (volume distribution standard) of 6.0 μm were obtained.

The cores that were obtained had a roundness of 0.93 (number average for 3,000 cores). The roundness was measured using a flow particle imaging analyzer (FPIA (registered Japanese trademark) 3000 manufactured by Sysmex Corporation).

The cores that were obtained had a Tg of 47° C. and a Tm of 90° C. Tg of the cores was measured using a differential scanning calorimeter (DSC-6220 produced by Seiko Instruments Inc.). Tm of the cores was measured using a capillary rheometer (CFT-500D produced by Shimadzu Corporation).

The cores that were obtained had a triboelectric charge of −20 μC/g. The triboelectric charge was measured with a standard carrier using a Q/m meter (Model 210HS-2A produced by Trek, Inc.). More specifically, the cores and a standard carrier N-01 (standard carrier for negative-charging toner) provided by The Imaging Society of Japan were mixed for 30 minutes using a TURBULA mixer. The amount of the cores was 7% by mass relative to the standard carrier. After mixing, the triboelectric charge was measured using the Q/m meter.

The zeta potential of the cores in a dispersion adjusted to pH 4 was measured using a zeta potential and particle size distribution analyzer (DelsaNano HC manufactured by Beckman Coulter, Inc.). More specifically, 0.2 g of the cores, 80 g of ion exchanged water, and 20 g of 1% by mass concentration non-ionic surfactant (polyvinylpyrrolidone K-85 produced by Nippon Shokubai Co., Ltd.) were mixed using a magnetic stirrer to uniformly disperse the cores in liquid. Through the above, a dispersion of the cores was obtained. Next, the dispersion was adjusted to pH 4 through addition of dilute hydrochloric acid. The resultant pH 4 dispersion of the cores was used as a measurement sample. The zeta potential of the cores in the measurement sample was measured using the zeta potential and particle size distribution analyzer. The cores had a zeta potential of −15 mV at pH 4. The measured results for the triboelectric charge and the zeta potential clearly indicate that the cores were anionic.

(Shell Layer Formation)

The following explains a procedure for forming shell layers in the preparation method of toner A.

A three-necked flask having a capacity of 1 L and equipped with a thermometer and a stirring impeller was set up, and the internal temperature of the flask was maintained at 30° C. using a water bath. Next, 300 mL of ion exchanged water was added to the flask and the aqueous medium in the flask was adjusted to pH 4 through addition of dilute hydrochloric acid.

Next, 2 mL of an aqueous solution of hexamethylol melamine prepolymer (MIRBANE (registered Japanese trademark) resin SM-607 produced by Showa Denko K.K.; solid component concentration 80% by mass) and 2 mL of an aqueous solution of acrylamide resin (BECKAMINE (registered Japanese trademark) A-1 produced by DIC Corporation; solid component concentration 11% by mass) were added to the flask. The contents of the flask were subsequently stirred in order to dissolve the methylol melamine and the acrylamide resin in the aqueous medium. In the preparation method of toner A, the volume ratio of the additive amount of the material for forming the thermosetting unit (i.e., MIRBANE resin SM-607) and the additive amount of the material for forming the thermoplastic unit (i.e., BECKAMINE A-1) was 5:5 (=1:1).

Next, 300 g of the cores prepared according to the process described above were added to the flask and the contents of the flask were sufficiently stirred.

Next, 300 mL of ion exchanged water was added to the flask. The internal temperature of the flask was increased to 70° C. at a rate of 1° C./minute while stirring the contents of the flask and the internal temperature was then maintained at 70° C. for two hours. Through the above, cationic shell layers containing a thermosetting resin (melamine resin) were formed over the surface of the cores. As a result of the above process, a dispersion of toner mother particles was obtained. Next, the dispersion was adjusted to pH 7 (i.e., neutralized) through addition of sodium hydroxide. The dispersion was subsequently cooled to room temperature (25° C.).

(Washing and Drying)

Once the toner mother particles (cores and shell layers) had been formed, the dispersion of the toner mother particles was subjected to vacuum filtration (i.e., solid-liquid separation) using a Buchner funnel (Nutsche filter). A wet cake of the toner mother particles was obtained through the vacuum filtration. Next, the toner mother particles were dispersed in ion exchanged water. The toner mother particles were washed by repeating steps of filtration and dispersion. The steps of filtration and dispersion were repeated until 10 g of the toner mother particles dispersed in 100 g of ion exchanged water had an electrical conductivity of no greater than 4 μS/cm. It is thought that so long as the electrical conductivity of the aforementioned dispersion is no greater than 10 μS/cm, there is no significant effect on chargeability of the toner. The electrical conductivity was measured using a HORIBA ES-51 electrical conductivity meter produced by HORIBA, Ltd. The filtrates contained almost none of the shell material (monomer or resin) that had been added. The filtrates after washing had a TOC concentration of no greater than 8 mg/L. The TOC concentration was measured using an online TOC analyzer (TOC-4200 produced by Shimadzu Corporation).

Next, the washed wet cake of toner mother particles was broken up and the toner mother particles were dried using a vacuum oven.

The shell layer thickness of the toner mother particles was measured according to the following method.

First, a plurality of toner mother particles were dispersed in a cold-setting epoxy resin and left to stand for two days at an ambient temperature of 40° C. to obtain a hardened material. The hardened material was dyed in osmium tetroxide and subsequently a flake sample was cut therefrom using an ultramicrotome (EM UC6 manufactured by Leica Microsystems) equipped with a diamond knife. Next, a transmission electron microscopy (TEM) image of a cross-section of the flake sample was captured using a transmission electron microscope (JSM-6700F produced by JEOL Ltd.).

The shell layer thickness was measured by analyzing the TEM image using image analysis software (WinROOF produced by Mitani Corporation). More specifically, on a cross-section of a toner particle, two straight lines were drawn to intersect at right angles at approximately the center of the cross-section. The lengths of four line segments overlapping with the shell layer were measured, thereby measuring thickness of the shell layer at four locations. The shell layer thickness of the toner particle subjected to measurement was determined to be the arithmetic mean of the four lengths that were measured. The shell layer thickness was measured with respect to each of an appropriate number of toner particles (for example, 10 particles) included in the toner. The arithmetic mean of the measured values (for example, 10 measured values) was used as an evaluation value.

When the shell layer is excessively thin, the TEM image may not clearly depict a boundary between the core and the shell layer, complicating measurement of thickness of the shell layer. In such a situation, the thickness of the shell layer was measured by using TEM and electron energy loss spectroscopy (EELS) in combination in order to clarify the boundary between the core and the shell layer. More specifically, in the captured TEM image, mapping was performed by EELS for an element (for example, nitrogen) contained in the shell layer.

Toner A had a shell layer thickness of 10 nm as measured according to the method described above. Also, the shell layers of toner A contained a thermoplastic unit and a thermosetting unit. More specifically, in the shell layers of toner A, the thermoplastic unit was cross-linked by the thermosetting unit. In toner A, the thermoplastic unit contained an acrylic component based on an acrylamide resin. Also, in toner A, the thermosetting unit was derived from methylol melamine (External Addition)

First, 100 parts by mass of the dried toner mother particles and 1 part by mass of dry silica fine particles (REA90 produced by Nippon Aerosil Co., Ltd.) were mixed using a mixer having a capacity of 5 L (FM mixer produced by Nippon Coke & Engineering Co., Ltd.). The mixing caused the external additive (i.e., the dry silica fine particles) to adhere to the surface of the toner mother particles. Through the above process, toner A including a large number of toner particles was obtained.

The following explains preparation methods of toners B-J. Note that unless specifically stated, the evaluation method of toners B-J was the same as the evaluation method of toner A. Each of toners B-F, H, and J had a shell layer thickness of 10 nm Toner I had a shell layer thickness of 15 nm In toner G, shell layers were not formed.

[Preparation Method of Toner B]

In the preparation method of toner B, the volume ratio of material additive amounts (i.e., a ratio MIRBANE resin SM-607:BECKAMINE A-1) during shell layer formation was 8:2 (=4:1) instead of 5:5 (=1:1), but in all other aspects toner B was prepared according to the same method as toner A.

[Preparation Method of Toner C]

In the preparation method of toner C, the volume ratio of material additive amounts (i.e., a ratio MIRBANE resin SM-607:BECKAMINE A-1) during shell layer formation was 2:8 (=1:4) instead of 5:5 (=1:1), but in all other aspects toner C was prepared according to the same method as toner A.

[Preparation Method of Toner D]

In the preparation method of toner D, the volume ratio of material additive amounts (i.e., a ratio MIRBANE resin SM-607:BECKAMINE A-1) during shell layer formation was 9:1 instead of 5:5 (=1:1), but in all other aspects toner D was prepared according to the same method as toner A.

[Preparation Method of Toner E]

In the preparation method of toner E, the volume ratio of material additive amounts (i.e., a ratio MIRBANE resin SM-607:BECKAMINE A-1) during shell layer formation was 1:9 instead of 5:5 (=1:1), but in all other aspects toner E was prepared according to the same method as toner A.

[Preparation Method of Toner F]

In the preparation method of toner F, the volume ratio of material additive amounts (i.e., a ratio MIRBANE resin SM-607:BECKAMINE A-1) during shell layer formation was 10:0 instead of 5:5 (=1:1), but in all other aspects toner F was prepared according to the same method as toner A. In the preparation method of toner F, the additive amount of the aqueous solution of hexamethylol melamine prepolymer (MIRBANE resin SM-607 produced by Showa Denko K.K.; solid component concentration 80% by mass) was 4 mL. Also, in the preparation method of toner F, the aqueous solution of acrylamide resin (BECKAMINE A-1 produced by DIC Corporation) was not added.

[Preparation Method of Toner G]

In the preparation method of toner G, the volume ratio of material additive amounts (i.e., a ratio MIRBANE resin SM-607:BECKAMINE A-1) during shell layer formation was 0:10 instead of 5:5 (=1:1), but in all other aspects toner G was prepared according to the same method as toner A. In the preparation method of toner G, the additive amount of the aqueous solution of acrylamide resin (BECKAMINE A-1 produced by DIC Corporation; solid component concentration 11% by mass) was 4 mL. Also, in the preparation method of toner G, the aqueous solution of hexamethylol melamine prepolymer (MIRBANE resin SM-607 produced by Showa Denko K.K.) was not added.

[Preparation Method of Toner H]

In the preparation method of toner H, a glyoxal-based monomer was added as a component of the shell material instead of methylol melamine (MIRBANE resin SM-607), but in all other aspects toner H was prepared according to the same method as toner A. More specifically, in the preparation method of toner H, 2 mL of the aqueous solution of acrylamide resin (BECKAMINE A-1 produced by DIC Corporation; solid component concentration 11% by mass) and 1.5 mL of an aqueous solution of the glyoxal-based monomer (BECKAMINE (registered Japanese trademark) NS-11 produced by DIC Corporation; solid component concentration 40% by mass) were added as the shell material.

[Preparation Method of Toner I]

In the preparation method of toner I, 1 mL of an acrylic emulsion (VONCOAT AN-1170 produced by DIC Corporation; solid component concentration 50% by mass) was used during shell layer formation instead of 2 mL of the aqueous solution of acrylamide resin (BECKAMINE A-1 produced by DIC Corporation), but in all other aspects toner I was prepared according to the same method as toner A.

[Preparation Method of Toner J]

In the preparation method of toner J, 2 mL of an aqueous solution of trimethylol melamine prepolymer (MIRBANE resin SM-850 (registered Japanese trademark) produced by Showa Denko K. K.; solid component concentration 80% by mass) was used during shell layer formation instead of 2 mL of the aqueous solution of hexamethylol melamine prepolymer (MIRBANE resin SM-607 produced by Showa Denko K. K.), but in all other aspects toner J was prepared according to the same method as toner A.

[Evaluation Method]

The following explains an evaluation method used for each of the samples (toners A-J).

(Hardness of Toner Mother Particles)

Evaluation was performed using, as an evaluation device, a scanning probe station (NanoNaviReal produced by Hitachi High-Tech Science Corporation) equipped with an SPM (S-image produced by Hitachi High-Tech Science Corporation) having an internal heater. Prior to measurement, the evaluation device was calibrated using poly(methyl methacrylate) (PMMA) particles as a reference material with an allowable range of 2.920±0.119 GPa (Young's modulus). The Young's modulus of the PMMA as measured after calibration of the evaluation device was 3.01 GPa.

The toner mother particles of a sample were mounted on a measurement table of the evaluation device without cleavage of the toner mother particles. The evaluation device was used to plot a force curve for the surface of the toner mother particles. Note that the toner mother particles corresponded to toner particles of the sample (any one of toners A-J) prior to external addition. The toner mother particles subjected to measurement had a particle diameter of 6 μm.

The force curve was converted to a "load/pressing distance" curve and a localized Young's modulus was calculated. Measurement of the Young's modulus was performed while changing the temperature of a cantilever of the SPM in a range from 30° C. to 70° C. More specifically, the cantilever temperature of the SPM was increased at a heating rate of 5° C./s and measurements of hardness (Young's modulus) of the surface of the toner mother particles were performed at cantilever temperatures of 30° C., 50° C., and 70° C. More specifically, for each of 10 toner mother particles included in the toner, the hardness (Young's modulus) was measured at three locations (each a location on the surface of the toner mother particle), thereby obtaining 30 measured values. The arithmetic mean of the 30 measured values was used as an evaluation value.

A proportion of change of the Young's modulus of the surface of the toner mother particles from 30° C. to 50° C. (herein referred to as a first proportion of hardness change) and a proportion of change of the Young's modulus of the surface of the toner mother particles from 50° C. to 70° C. (herein referred to as a second proportion of hardness change) were measured based on the following expressions.

First proportion of hardness change (%)=100×
|Young's modulus at 30° C.−Young's modulus at 50° C.|/Young's modulus at 30° C.

Second proportion of hardness change (%)=100×
|Young's modulus at 50° C.−Young's modulus at 70° C.|/Young's modulus at 50° C.

Note that the first proportion of hardness change and the second proportion of hardness change are both absolute values.

Herein, a value obtained by dividing the second proportion of hardness change by the first proportion of hardness change as shown below is referred to as a ratio of proportions of hardness change.

Ratio of proportions of hardness change =second proportion of hardness change/first proportion of hardness change In evaluation of each of the samples (toners A-J), hardness of the toner mother particles was measured prior to external addition. However, the toners may be evaluated according to a different method. For example, the external additive may be removed from the toner particles after external addition thereof, and hardness of the toner mother particles obtained thereby may be measured. The external additive can be removed from the toner particles by using an alkaline solution (for example, an aqueous solution of sodium hydroxide) to dissolve the external additive. Alternatively, the external additive may be removed from the toner particles using an ultrasonic washer.

(Fixability)

Fixability was evaluated using a printer (FS-05250DN produced by KYOCERA Document Solutions Inc., modified to enable adjustment of fixing temperature) having a roller-roller type heat-pressure fixing section (nip width 8 mm) as an evaluation device. A two-component developer was prepared by mixing 100 parts by mass of a developer carrier (carrier for FS-05250DN) and 10 parts by mass of a sample (toner) for 30 minutes using a ball mill The two-component developer that was prepared was loaded into a developing section of the evaluation device and the sample (toner) was loaded into a toner container of the evaluation device.

The evaluation device was used to convey 90 g/m$^2$ paper at a linear velocity of 200 mm/s and to develop 1.0 mg/cm$^2$ of toner on the paper during conveyance. The toner was used to form a solid image. After development, the paper was passed through the fixing section. The transit time of the paper through a nip of the fixing section was 40 ms. The fixing temperature was set in a range from 100° C. to 200° C. More specifically, a minimum temperature at which the toner (solid image) was fixable to the paper (i.e., a minimum fixing temperature) was measured by increasing the fixing temperature of the fixing section from 100° C. in increments of 5° C. Determination of whether or not the toner was fixable at a given temperature was carried out through a fold-rubbing test such as described below (i.e., by measuring the length of toner peeling at a fold).

The fold-rubbing test was performed by folding the paper in half such that a surface on which the image was formed was folded inwards, and by rubbing a 1 kg weight covered with cloth back and forth on the fold five times. Next, the paper was opened up and a fold portion (i.e., a portion to which the solid image was fixed) was observed. The length of toner peeling of the fold portion (peeling length) was measured. The minimum fixing temperature was determined to be the lowest temperature among temperatures for which the peeling length was no greater than 1 mm.

A minimum fixing temperature of no greater than 160° C. was evaluated as good and a minimum fixing temperature of greater than 160° C. was evaluated as poor.

(Preservability)

First, 2 g of a sample (toner) was placed in a plastic container having a capacity of 20 mL and the plastic container was left to stand for three hours in a thermostatic chamber set to 60° C. Through the above, an evaluation toner was obtained. The evaluation toner was cooled to 20° C. for three hours and was then placed on a 100-mesh sieve of known mass. The mass of the toner prior to sifting was calculated by measuring the total mass of the sieve and the toner thereon. Next, the sieve was placed in a powder tester (product of Hosokawa Micron Corporation) and the evaluation toner was sifted in accordance with a manual of the powder tester by shaking the sieve for 30 seconds at a rheostat level of 5. After the sifting, the mass of toner remaining on the sieve was calculated by once again measuring the total mass of the sieve and the toner thereon. Aggregation of the toner (% by mass) was calculated from the mass of the toner prior to sifting and the mass of the toner after sifting (mass of the toner remaining on the sieve after sifting) based on the expression shown below.

$$\text{Aggregation (\% by mass)} = 100 \times \text{mass of toner after sifting/mass of toner prior to sifting}$$

Aggregation of no greater than 20% by mass was evaluated as good and aggregation of greater than 20% by mass was evaluated as poor.

[Evaluation Results]

Table 2 summarizes the results for measurement of hardness of the toner mother particles for each of toners A-F and H-J.

TABLE 2

| | Young's modulus of shell layers (GPa) | | | Proportion of change of Young's modulus of shell layers (%) | | |
|---|---|---|---|---|---|---|
| Toner | 30° C. | 50° C. | 70° C. | 30° C. to 50° C. (X) | 50° C. to 70° C. (Y) | Y/X |
| Toner A | 3.52 | 2.99 | 1.04 | 15.1 | 65.2 | 4.3 |
| Toner B | 3.98 | 3.58 | 2.50 | 10.1 | 30.2 | 3.0 |
| Toner C | 3.15 | 2.52 | 0.50 | 20.0 | 80.2 | 4.0 |
| Toner D | 4.10 | 3.81 | 3.24 | 7.1 | 15.0 | 2.1 |
| Toner E | 3.00 | 2.25 | 0.22 | 25.0 | 90.2 | 3.6 |
| Toner F | 4.20 | 3.99 | 3.54 | 5.0 | 11.3 | 2.3 |
| Toner G | — | — | — | — | — | — |
| Toner H | 3.30 | 2.70 | 0.27 | 18.2 | 90.0 | 4.9 |
| Toner I | 3.50 | 2.87 | 0.14 | 18.0 | 95.1 | 5.3 |
| Toner J | 3.20 | 2.78 | 1.11 | 13.1 | 60.1 | 4.6 |

For toner A, the Young's modulus at 30° C. was 3.52 GPa, the Young's modulus at 50° C. was 2.99 GPa, the Young's modulus at 70° C. was 1.04 GPa, the first proportion of hardness change (X) was 15.1%, the second proportion of hardness change (Y) was 65.2%, and the ratio of the proportions of hardness change (Y/X) was 4.3.

For toner B, the Young's modulus at 30° C. was 3.98 GPa, the Young's modulus at 50° C. was 3.58 GPa, the Young's modulus at 70° C. was 2.50 GPa, the first proportion of hardness change (X) was 10.1%, the second proportion of hardness change (Y) was 30.2%, and the ratio of the proportions of hardness change (Y/X) was 3.0.

For toner C, the Young's modulus at 30° C. was 3.15 GPa, the Young's modulus at 50° C. was 2.52 GPa, the Young's modulus at 70° C. was 0.50 GPa, the first proportion of hardness change (X) was 20.0%, the second proportion of hardness change (Y) was 80.2%, and the ratio of the proportions of hardness change (Y/X) was 4.0.

For toner D, the Young's modulus at 30° C. was 4.10 GPa, the Young's modulus at 50° C. was 3.81 GPa, the Young's modulus at 70° C. was 3.24 GPa, the first proportion of hardness change (X) was 7.1%, the second proportion of hardness change (Y) was 15.0%, and the ratio of the proportions of hardness change (Y/X) was 2.1.

For toner E, the Young's modulus at 30° C. was 3.00 GPa, the Young's modulus at 50° C. was 2.25 GPa, the Young's modulus at 70° C. was 0.22 GPa, the first proportion of hardness change (X) was 25.0%, the second proportion of hardness change (Y) was 90.2%, and the ratio of the proportions of hardness change (Y/X) was 3.6.

For toner F, the Young's modulus at 30° C. was 4.20 GPa, the Young's modulus at 50° C. was 3.99 GPa, the Young's modulus at 70° C. was 3.54 GPa, the first proportion of hardness change (X) was 5.0%, the second proportion of hardness change (Y) was 11.3%, and the ratio of the proportions of hardness change (Y/X) was 2.3.

For toner H, the Young's modulus at 30° C. was 3.30 GPa, the Young's modulus at 50° C. was 2.70 GPa, the Young's modulus at 70° C. was 0.27 GPa, the first proportion of hardness change (X) was 18.2%, the second proportion of hardness change (Y) was 90.0%, and the ratio of the proportions of hardness change (Y/X) was 4.9.

For toner I, the Young's modulus at 30° C. was 3.50 GPa, the Young's modulus at 50° C. was 2.87 GPa, the Young's modulus at 70° C. was 0.14 GPa, the first proportion of hardness change (X) was 18.0%, the second proportion of hardness change (Y) was 95.1%, and the ratio of the proportions of hardness change (Y/X) was 5.3.

For toner J, the Young's modulus at 30° C. was 3.20 GPa, the Young's modulus at 50° C. was 2.78 GPa, the Young's modulus at 70° C. was 1.11 GPa, the first proportion of hardness change (X) was 13.1%, the second proportion of hardness change (Y) was 60.1%, and the ratio of the proportions of hardness change (Y/X) was 4.6.

The toner mother particles are considered to have a Young's modulus of approximately 2.00 GPa in a composition in which the shell layers are formed using only a thermoplastic resin.

Table 3 summarizes the results of evaluation of fixability and preservability for each of toners A-F and H-J.

TABLE 3

| Toner | Fixability (° C.) | Preservability (% by mass) |
|---|---|---|
| Toner A | 150 | 8 |
| Toner B | 160 | 6 |
| Toner C | 145 | 15 |
| Toner D | 170 | 6 |
| Toner E | 140 | 79 |
| Toner F | 170 | 5 |
| Toner G | — | — |
| Toner H | 150 | 15 |
| Toner I | 145 | 10 |
| Toner J | 135 | 11 |

For each of toners A-C, E, and H-J, the minimum fixing temperature was no greater than 160° C. For each of toners D and F, the minimum fixing temperature was greater than 160° C.

For each of toners A-D, F, and H-J, aggregation was no greater than 20% by mass. For toner E, aggregation was greater than 20% by mass.

As explained above, for each of toners A-C and H-J (herein referred to as toners according the present Examples), the first proportion of hardness change (proportion of change of the Young's modulus from 30° C. to 50° C.) was no greater than 20.0%. Also, for each of the toners according to the present Examples, the ratio of the proportions of hardness change (i.e., a value yielded when the proportion of change of the Young's modulus from 50° C. to 70° C. is divided by the proportion of change of the Young's modulus from 30° C. to 50° C.) was at least 3.0 and no greater than 10.0. For each of the toners according to present Examples, the minimum fixing temperature was no greater than 160° C. and aggregation was no greater than 20% by mass. Each of the toners according to the present Examples had good high-temperature preservability and low-temperature fixability.

Furthermore, as shown in Table 3, each of toners A and I had a minimum fixing temperature of no greater than 150° C. and aggregation of no greater than 10% by mass. Therefore, each of toners A and I had especially good high-temperature preservability and low-temperature fixability.

For each of the toners according to the present Examples, the surface of the toner mother particles had a Young's modulus of at least 2.00 GPa and no greater than 4.50 GPa (more specifically, at least 3.00 GPa and no greater than 4.00 GPa) when measured using the SPM while the cantilever temperature thereof was 30° C. For each of the toners according to the present Examples, the thickness of the shell layers was at least 1 nm and no greater than 20 nm (more specifically, 10 nm). In each of the toners according to the present Examples, the thermoplastic unit contained an acrylic component (i.e., an acrylic component based on an acrylamide resin or an acrylic emulsion). Also, in each of the toners according the present Examples, the thermosetting unit was a unit derived from a monomer or prepolymer of a melamine resin (more specifically, methylol melamine).

In the preparation method of each of the toners according to the present Examples, the Young's modulus of the surface of the shell layers formed over the surface of the cores was adjusted based on the ratio (herein referred to as a shell-hardening ratio) of the additive amount of the material for forming the thermosetting unit relative to the additive amount of the material for forming the thermoplastic unit. Therefore, a toner having good high-temperature preservability and low-temperature fixability could be easily manufactured.

In the preparation method of each of the toners according to the present Examples, the material for forming the thermosetting unit was methylol melamine. In the preparation method of each of toners A-C, H, and J, the material for forming the thermoplastic unit was an acrylamide resin. In the preparation method of toner I, the material for forming the thermoplastic unit was an acrylic emulsion.

The present disclosure is of course not limited to the Examples described above.

A toner is considered to have good high-temperature preservability and low-temperature fixability when satisfying conditions that the first proportion of hardness change is no greater than 20.0% and that the ratio of the proportions of hardness change is at least 3.0 and no greater than 10.0.

In a toner manufacturing method, adjusting the Young's modulus of the surface of shell layers formed over the surface of cores based on the aforementioned shell-hardening ratio is considered to facilitate production of a toner having good high-temperature preservability and low-temperature fixability.

What is claimed is:

1. A toner comprising a plurality of toner particles each including:

a core; and a shell layer disposed over a surface of the core, wherein the shell layer contains a unit derived from a thermoplastic resin and a unit derived from a monomer or prepolymer of a thermosetting resin, a surface of each of the toner particles has a Young's modulus that when measured in a state in which an external additive is not adhered to the toner particle using a scanning probe microscope while raising a cantilever temperature thereof, the Young's modulus:

changes by a proportion of no greater than 20% from 30° C. to 50° C.; and changes by a proportion from 50° C. to 70° C. that when divided by the proportion of change from 30° C. to 50° C., yields a value of at least 3.0 and no greater than 10.0, the unit derived from the thermoplastic resin contains an acrylic component, and the unit derived from the monomer or prepolymer of the thermosetting resin contains a unit derived from a monomer or prepolymer of a melamine resin or a glyoxal resin.

2. A toner according to claim 1, wherein the Young modulus of the surface of the toner particle is at least 2.00 GPa and no greater than 4.50 GPa when measured in the state in which the external additive is not adhered to the surface of the toner particle using the scanning probe microscope while the cantilever temperature thereof is 30° C.

3. A toner according to claim 2, wherein the Young modulus of the surface of the toner particle is at least 3.00 GPa and no greater than 4.00 GPa when measured in the state in which the external additive is not adhered to the surface of the toner particle using the scanning probe microscope while the cantilever temperature thereof is 30° C.

4. A toner according to claim 1, wherein the shell layer has a thickness of at least 1 nm and no greater than 20 nm.

5. A toner according to claim 1, wherein the unit derived from the monomer or prepolymer of the thermosetting resin is a methylol melamine resin.

6. A toner according to claim 1, wherein the acrylic component contains an acrylamide resin or an acrylic resin.

7. A toner according to claim 1, wherein the acrylic component contains the acrylamide resin.

8. A toner according to claim 1, wherein the acrylic component contains the acrylic resin.

9. A toner according to claim 1, wherein the unit derived from the thermoplastic resin is cross-linked by the unit derived from the monomer or prepolymer of the thermosetting resin.

10. A toner according to claim 1, wherein the core contains a colorant.

11. A toner according to claim 10, wherein the colorant includes a phthalocyanine pigment.

12. A toner according to claim 1, wherein the core contains a releasing agent.

13. A toner according to claim 12, wherein the releasing agent includes an ester wax.

14. A toner according to claim 1, wherein the core contains a binder resin including a polyester resin.

15. A toner according to claim 14, wherein the polyester resin has a hydroxyl value of at least 10 mg KOH/g.

16. A toner according to claim 14, wherein the polyester resin has an acid value of at least 10 mg KOH/g.

17. A toner according to claim 14, wherein the polyester resin has a glass transition point of at least 20° C. and no greater than 55° C.

18. A toner according to claim 14, wherein the polyester resin has a softening point of no greater than 105° C.

19. A toner according to claim 1, wherein the plurality of toner particles each further includes an external additive.

20. A toner according to claim 19, wherein the external additive includes silica particles.

* * * * *